US005772166A

United States Patent [19]

Adams

[11] Patent Number: 5,772,166

[45] Date of Patent: Jun. 30, 1998

[54] MOUNTING CLIP

[75] Inventor: William E. Adams, Portersville, Pa.

[73] Assignee: Adams Mfg. Corp., Portersville, Pa.

[21] Appl. No.: 593,828

[22] Filed: Jan. 30, 1996

Related U.S. Application Data

[63] Continuation-in-part of Ser. No. 227,034, Apr. 13, 1994, abandoned, and Ser. No. 339,025, Nov. 14, 1994, Pat. No. 5,531,411.

[51] Int. Cl.[6] ..... F21S 1/00

[52] U.S. Cl. ..... 248/231.81; 248/229.16; 248/229.26

[58] Field of Search ..... 248/231.81, 229.16, 248/229.26; 362/396, 249; 24/336, 16 PB

[56] References Cited

U.S. PATENT DOCUMENTS

| | | | |
|---|---|---|---|
| 1,858,656 | 5/1932 | Batherman | 248/299 X |
| 1,861,151 | 5/1932 | Buschman | 248/299 X |
| 1,895,656 | 1/1933 | Gadke . | |
| 2,456,553 | 12/1948 | Churchill | 248/231.8 |
| 2,644,383 | 7/1953 | Meditz | 248/229.16 X |
| 2,782,296 | 9/1957 | Walter . | |
| 3,131,447 | 5/1964 | Tinnerman | 248/231.81 |
| 3,151,926 | 10/1964 | Schick et al. | 339/99 |
| 3,182,944 | 5/1965 | Laviano | 248/226 |
| 3,189,310 | 6/1965 | Truseon | 248/314 |
| 3,291,428 | 12/1966 | Sisulak | 248/204 |
| 3,473,768 | 10/1969 | Piasecki | 248/68.1 |
| 3,481,570 | 12/1969 | Shettel | 248/231.8 X |
| 3,540,687 | 11/1970 | Cuva . | |
| 3,565,375 | 2/1971 | Babb | 248/74 X |
| 3,599,916 | 8/1971 | Szabo | 248/231.8 X |
| 3,716,818 | 2/1973 | Finkelstein | 339/97 |
| 3,861,632 | 1/1975 | Siilats | 248/223 |
| 3,883,926 | 5/1975 | Reynolds | 248/229.16 X |
| 4,103,860 | 8/1978 | Haas et al. | 248/475.1 X |
| 4,121,798 | 10/1978 | Schumacher et al. | 248/229.26 X |
| 4,127,911 | 12/1978 | Cupp et al. | 403/329 X |
| 4,186,902 | 2/1980 | Simons | 248/73 |
| 4,436,269 | 3/1984 | Dirksing et al. | 403/329 X |
| 4,491,902 | 1/1985 | Cangelosi | 362/389 |
| 4,707,892 | 11/1987 | Nelson | 24/336 |
| 4,851,977 | 7/1989 | Gary . | |
| 4,883,290 | 11/1989 | Landa | 24/336 X |
| 4,901,212 | 2/1990 | Prickett . | |
| 4,905,131 | 2/1990 | Gary . | |
| 5,056,198 | 10/1991 | Viglione | 24/336 |
| 5,056,747 | 10/1991 | Kireta | 248/231.8 |
| 5,112,013 | 5/1992 | Tolbert et al. | 248/74.3 |
| 5,137,243 | 8/1992 | Stevens et al. | 248/316.7 |
| 5,228,774 | 7/1993 | Liao | 362/391 |
| 5,249,108 | 9/1993 | Gary . | |
| 5,326,068 | 7/1994 | Spears | 248/229 X |
| 5,385,485 | 1/1995 | Fu | 439/419 |
| 5,388,802 | 2/1995 | Dougan et al. | 248/74.2 |
| 5,389,008 | 2/1995 | Cheng et al. | 429/419 |
| 5,555,607 | 9/1996 | Parveris | 24/336 X |
| 5,593,126 | 1/1997 | Muderlak | 248/316.7 |

FOREIGN PATENT DOCUMENTS 672562 10/1963 Canada .

OTHER PUBLICATIONS

Gary Products Group, Inc. "Lites Up" Brochure.

*Primary Examiner*—Ramon O. Ramirez
*Assistant Examiner*—Donald J. Wallace
*Attorney, Agent, or Firm*—Buchanan Ingersoll, P.C.

[57] ABSTRACT

A mounting clip having a generally U-shaped clip body, a mounting extending from the clip body, and a light holder releasably or permanently attached to the mounting. The mounting clip is formed from a resilient material. The mounting clip can be utilized to mount various size lights on both gutters and roofing shingles. Display holders displaying decorative figures and reflectors can be positioned on the mounting clip along with the light holder.

14 Claims, 7 Drawing Sheets

MOUNTING CLIP

CROSS REFERENCE TO RELATED APPLICATIONS

This is a continuation-in-part of U.S. patent application Ser. No. 08/227,034, filed Apr. 13, 1994, now abandoned and U.S. patent application Ser. No. 08/339,025, filed Nov. 14, 1994, U.S. Pat. No. 5,531,411.

FIELD OF THE INVENTION

This invention relates to mounting clips for attaching lights to various structures. More particularly, this invention concerns a mounting clip for attaching lights to roofing shingles and gutters having a light holder releasably or permanently attached to the mounting clip. The mounting clip can accept multiple, various size light holders each accommodating a different size light or accept only one flexible, multi-purpose light holder which retains various size lights.

DESCRIPTION OF THE PRIOR ART

The use of lights for decorating the exterior of a house is well known. Decorative lights typically consist of a large number of light sockets being wired together with light bulbs positioned in the light sockets. The "string" of lights is then attached to the face of a building. The "string" of lights can be mounted by retaining either the light socket or the wire. My mounting clip is concerned with a holder that retains the light socket.

The object of these holders is to display the lights so that they can easily be seen. The holders must not be adversely affected by cold temperatures and should be able to hold the lights during high winds which commonly accompany winter storms.

Further, most prior art light mountings which grasp light sockets only accept one size light. However, there are three sizes of outdoor lights which are commonly displayed. Because the prior art mountings accept only one size light an entire new mounting would be necessary if a different size light is to be displayed.

Some prior art light mountings attach lights permanently to a structure. By permanently attaching the mountings to a house frame, gutter or other surface, the surface is marred permanently. Because decorative lighting is seasonal the lights are usually removed after the holidays at which time the marred surface is exposed.

One type of conventional, permanent light mounting is a two-piece rigid configuration comprising a base portion and a light socket retainer. The base portion is in the form of an L-shaped configuration. One leg of the L-shape base portion is permanently mounted to a relatively flat surface of a house such as a window frame. The other leg of the L-shape is a channel member having flanges on opposite sides which accommodate the light socket retainer. The light socket retainer slides into the channel member. The light socket retainer has two resilient clamp members which grasp a light. This type of light mounting is described in U.S. Pat. No. 3,540,687.

Another prior art device provides an L-shaped light support bracket with one of the legs being fitted under a shingle. The other leg includes a hole sized to receive a light bulb. This type of light support bracket can also be positioned within a retaining strip which is permanently attached to a flat building surface. Examples of these light mountings are shown in U.S. Pat. Nos. 4,905,131; 4,901,212; and 4,851,977. and has been sold under the trademark "LITES UP" by Gary Products Group, Inc. This type of mounting is easy to dislodge and frequently will come loose during winter storms.

Other related art devices concern mounting electric lights on Christmas trees. One such device comprises a spring-biased H-shaped clip having a cylindrical light socket attached to the top of the clip. Multiple clips are connected together by insulated electrical wire. A light bulb is placed in each of the light sockets and the string of electrical wire is positioned on a Christmas tree wherein each clip attaches a light to a branch of the Christmas tree.

Another device for mounting light bulbs to Christmas trees provides a resilient clamp which grips the light bulb and spring fingers extending perpendicularly from the resilient clamp which grasps a tree limb. Examples of light mountings for attaching lights to Christmas tree branches are illustrated in U.S. Pat. Nos. 2,782,296 and 1,895,656. This type of mounting is relatively expensive and more difficult to make than my mounting clip.

All of the prior art mentioned do not provide a light mounting having a light holder which is releasably or permanently connected to a clip body with the ability to retain various size lights. The nonpermanent prior art light mountings do not provide a stable mounting while permanent holders permanently mar the mounting surface.

There is a need for an inexpensive nonpermanent holder for retaining various size outdoor lights which will securely retain the lights when subjected to winter storms.

SUMMARY OF THE INVENTION

I provide a mounting clip for mounting lights on various structures. The mounting clip comprises a generally U-shaped clip body, a mounting extending from the clip body and a light holder releasably or permanently connected to the mounting. In accordance with one aspect of my mounting clip, the mounting clip allows for the retention of various size lights. I provide a mounting which can accept various size light holders corresponding to various size lights. Alternatively, my mounting clip can be provided with one light holder which accepts multiple size lights. Thus, various size lights can be utilized within one light display without an entire new mounting being necessary to display the different size lights.

I provide one embodiment of my mounting clip for attaching lights to roofing shingles. The clip body having a tapered surface on one of the ends enables the clip to slide under a roofing shingle with only minimum distortion of the roofing shingle.

A second embodiment of my mounting clip enables a light to be mounted on a gutter. The clip body is made from resilient material providing for the clip to expand partially encompassing the gutter and then contract securely grasping the gutter. In this embodiment the ends of the clip body which expand to partially encompass the gutter are bevelled inwardly with respect to the mounting clip in order to facilitate the mounting of the clip around the gutter. I prefer to provide at least one transverse or partially transverse rib to improve the grip of the clip.

I further provide various mountings which releasably attach the light holder to the clip body. In accordance with one aspect of my invention, two tabs are provided on the clip body both having a plurality of barbs positioned thereon which engage a light holder. The light holder is substantially H-shaped with a cross-leg engaging the barbs resulting in a secure attachment of the light holder to the clip body.

Further, I provide that the substantially H-shaped light holder be formed from resilient material such that it is deformable sufficiently to grasp a light and securely hold the light for an extended time period. The light holder can be made in a U-shaped form as well. The U-shaped light holder may include grooves along both of its resilient legs increasing the gripping potential of the light holder. Further, the light holder can take the form of a clamp which is also formed from resilient material. The light holder releasably attached to the mounting can be of various sizes in order to retain various size lights.

In accordance with another aspect of my mounting clip, I provide another mounting having two tabs extending substantially perpendicularly from the clip body. The light holder includes a projection with a plurality of apertures therethrough at least two of which engage the two tabs. Stops can be provided on the tabs such that the light holder projection engages the stops. The stops are positioned on the two tabs at a distance which prevents the light from physically contacting any object.

I further provide a light holder which is a S-shaped flexible, gripping member that retains all common size lights. The S-shaped flexible, gripping member is mounted on the mounting. Alternatively, the light holder can be a C-shaped, flexible, gripping member that is able to retain all common size lights. Preferably, the S-shaped light holder, the mounting and the clip body are molded to form a one-piece construction. The light holder can be provided with nodules which engage the light to more securely retain the light.

My mounting clip can be molded to form a one piece configuration that can be separated into a light holder component and a clip body and mounting component. Preferably, the one piece configuration is provided with at least one runner which connects the light holder component to the clip body and mounting component. Hinges are provided at the connection points between the runner and the clip body component and between the runner and the light holder which facilitate the separation of the component parts. After separation into the component parts, the light holder component can be positioned on the mounting.

In accordance with another aspect of my mounting clip, at least a portion of the clip body surface which engages the mounting surface is roughened in order to create greater adhesion between the mounting clip and mounting surface.

I further provide a display holder to be positioned on the mounting clip along with the light holder. The display holder has a base and an upright extending from the base. The display holder can display both decorative figures and reflectors. The decorative figures or reflectors are mounted on the upright guide edge and stabilized with respect to the upright by locking tabs. Alternatively, the mounting clip can be provided with a second clip which can be generally L-shaped on which the decorative figures or reflectors can be mounted.

Additional details, object and advantages of the invention will become more readily apparent as the following description of certain present preferred embodiments thereof proceed.

BRIEF DESCRIPTION OF THE DRAWINGS

The accompanied drawings show presently preferred embodiments of my mounting clip in which.

Similar reference numerals are used to indicate similar parts in all figures of the drawings.

DETAILED DESCRIPTION OF THE PREFERRED EMBODIMENT

Figure 1:
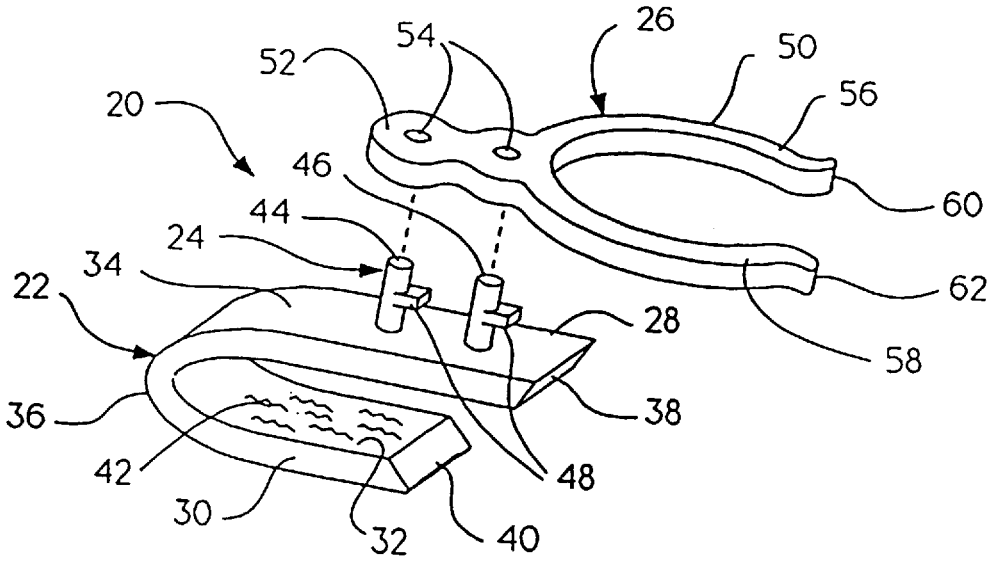
FIG. 1 is a perspective view of a first presently preferred embodiment of my mounting clip.

As shown in FIG. 1, a first presently preferred embodiment of my mounting clip 20 is substantially comprised of a generally U-shaped, resilient clip body 22, a mounting 24, and a light holder 26. Clip body 22 has a first leg 28, a second leg 30, an interior surface 32, an exterior surface 34 and a bridge portion 36 which extends between first leg 28 and second leg 30. Clip body 22 further includes a proximate end 38 and a distal end 40 where distal end 40 is tapered in order to facilitate clip body 22 sliding under a roofing shingle (not shown) with minimum distortion. Although not shown, U-shaped clip body 22 can be made to slide over the internal lip of a gutter. Interior surface 32 of the second leg 30 preferably includes a roughened surface 44 for the purpose of creating better adhesion between mounting clip 20 and roofing shingles or any mounting surface. Alternatively, second leg interior surface 32 can be provided with grooves (not shown). Second leg 30 is shown as being shorter in length than first leg 28. Although not illustrated, first leg 28 could be shorter or the same length as second leg 30 depending on the distance necessary for mounting clip 20 to slide under and engage the shingle in order to create a secure connection.

Mounting 24 comprises a first tab 44 and a second tab 46 each having a stop 48. Stops 48 are positioned at a distance away from the exterior surface 34 of first leg 28. The distance is selected in order that a light (not shown) being held by light holder 26 will not come into contact with any object such as a roofing shingles, a gutter or the mounting clip and create a fire hazard. Light holder 26 comprises a clamp member 50 and a projection 52. Projection 52 has two apertures 54 extending therethrough which engage first tab 44 and second tab 46. The projection 52 may also be provided with more than two apertures in order to be able to adjust the placement of light holder 26. Light holder 26 can easily be replaced with another size light holder when it is necessary to display different size lights. Consequently, the manufacturer, and possibly the retailer can maintain a smaller inventory since the same clip body 22 is used for all light sizes, albeit with differently sized light holders. Arms 56, 58 of clamp member 50 each have a distal end 60, 62 which extend outwardly. Two arms 56, 58 are made of resilient material such that arms 56, 58 can be expanded to partially encompass a light and then released to grip and retain the light for an extended time period.

Figure 2:
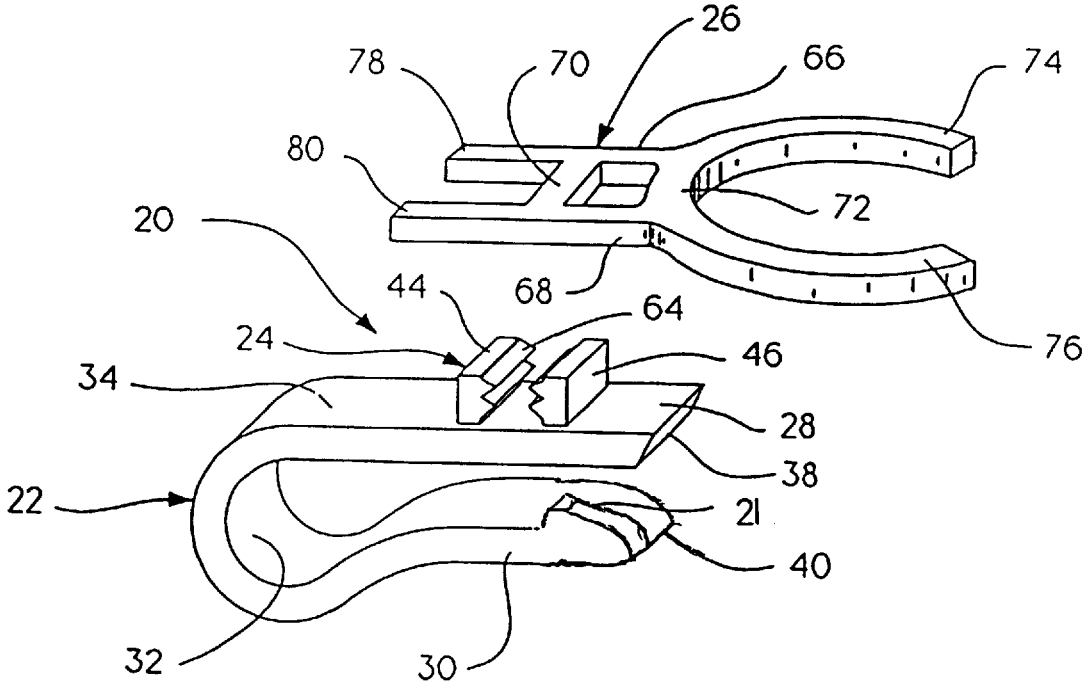
FIG. 2 is a perspective view of a second presently preferred embodiment of my mounting clip.

A second embodiment of my mounting clip which can be utilized to mount lights on gutters is shown in FIG. 2. Clip body 22 is in the form of a modified U-shape where second leg 30 is sloped towards proximate end 38, and distal end 40 is substantially parallel to first leg 28. Clip body 22 is formed from resilient material such that second leg 30 can be sufficiently spread apart from first leg 28 in order that a gutter (not shown) or another object may be inserted between first leg 28 and second leg 30. Proximate end 38 and distal end 40 are both bevelled inwardly or rounded with respect to clip body 22 thus, permitting easy insertion of the gutter or other object. A partially transverse rib 21 is provided on leg 30 to augment the grip of the clip on the gutter or other object to be decorated. Mounting 24 takes the form of a first tab 44 and a second tab 46 extending from exterior surface 34 of clip body 22. Both first tab 44 and second tab 46 have barbs 64. Light holder 26 is substantially H-shaped having a first leg 66, a second leg 68 and a first cross-leg 70 and a second cross-leg 72. Both first leg 66 and second leg 68 each have a first end 74, 76 and a second end 78, 80, respectively. When connecting light holder 26 to mounting 24, either first cross-leg 70 or second cross-leg 72 engage mounting barbs 64 and light holder 26 is secured to the clip body 22. Light holder 26 having first cross-leg 70 and second cross-leg 72 enables the light holder 26 and thus the light (not shown) to be adjustably positioned with respect to the clip body 22. Light holder 26 is made of resilient material such that both first leg first end 74 and first leg second end 76 are capable of expanding and surrounding a light (not shown) and holding the light for an extended time period.

Figure 3:
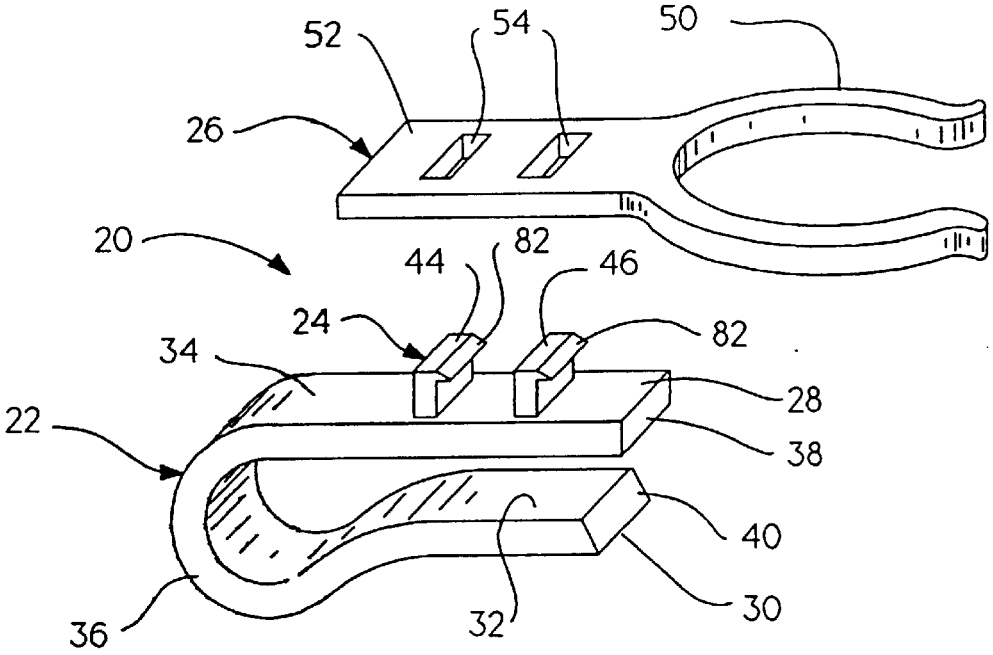
FIG. 3 is a perspective view of a third presently preferred embodiment of my mounting clip.

FIG. 3 illustrates another embodiment of my mounting clip 20 which is similar to the mounting clip 20 illustrated in FIG. 2. Clip body 22 is made from a resilient material and has a first leg 28 and a second leg 30. Mounting 24 is attached to clip body exterior surface 34. Mounting 24 is two tabs 44, 46 each having a triangular protuberance 82 extending from the top of each of tab 44, 46. Light holder 26 includes a projection 52 and a clamp member 50. Projection 52 has two apertures 54 spaced apart along the length of projection 52. Both tabs 44, 46 and light holder 26 are also formed of a resilient material such that projection apertures 54 engage tabs 44, 46. Triangular protuberances 82 deform when engaging the edges of apertures 54 and prevent light holder 26 from disengaging from the clip body 22. Although protuberances 82 are illustrated as being triangular and apertures 54 are illustrated as being rectangular, both element can take a variety of shapes.

Figure 4:
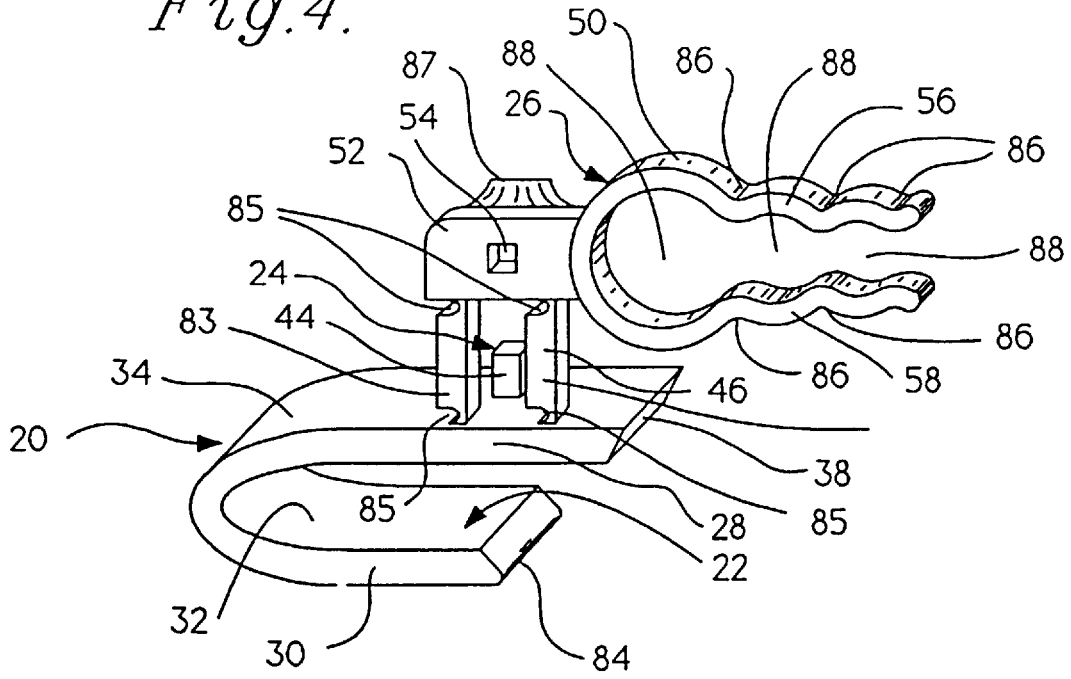
FIG. 4 is a perspective view of a fourth presently preferred embodiment of my mounting clip before it is assembled.

FIG. 4 illustrates yet another embodiment of my invention in which clip body 22, mounting 24 and light holder 26 are molded to form a one piece configuration. Light holder 26 is connected to clip body 22 by runners 83. Each runner 83 is attached to light holder 26 and clip body 22 by hinges 85. Clip body 22 is similar to that shown in FIG. 1 wherein distal end 40 is tapered and second leg 30 is shorter in length than first leg 28. Edges 84 of distal end 40 are rounded to prevent damage to shingles (not shown) when distal end 40 engages shingles. Mounting 24 is a first tab 44 extending substantially perpendicular from exterior surface 34 of clip body 22. Projection 52 includes an aperture 54 which extends through boss 87. Projection 52 is attached to a substantially U-shaped member 50. U-shaped clamp 50 comprises a first arm 56 and a second arm 58 both having a plurality of grooves 86. Grooved arms 56, 58 are formed of a resilient material such that they engage and retain lights (not shown). Grooves 86 are positioned on arms 56, 58 forming three recesses 88 such that the three recesses 86 are each of a different size allowing arms 56, 58 to grip different size lights. Specifically, grooves 86 closest to the projection 52 can grip a larger light than groove 86 positioned farthest from projection 52. Although, not shown, grooves 86 can be provided such that a small size light can be retained closest to projection 52 and the larger size light can be retained at a position farthest from projection 52. In use, runners 83 are separated from both clip body 22 and light holder 26 along hinges 85. Tab 44 then extends through aperture 54 of projection 52. Alternatively, hinges 85, projections 44 and aperture 54 could be sized and positioned to permit projection 52 to fold down and lock onto projection 44. Light holder 26 along with both mounting 24 and clip body 22 can be molded to form a one piece configuration. In this case runners 83 would not be necessary.

Figure 5:
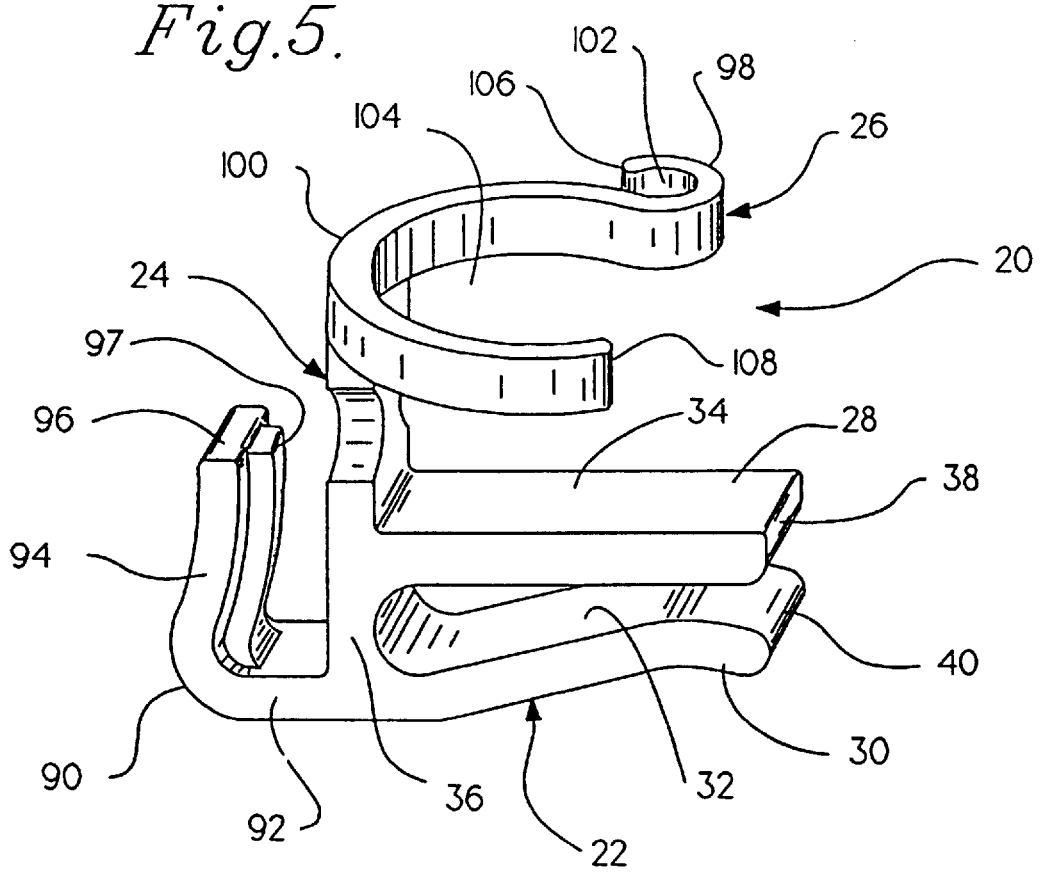
FIG. 5 is a perspective view of a fifth presently preferred embodiment of my mounting clip.

Another presently preferred embodiment of my mounting clip 20 is illustrated in FIG. 5. Clip body 22, mounting 24 and light holder 26 are molded to form a one-piece configuration. Clip body 22 is generally U-shaped having a first leg 28 and a second leg 30 with a bridge portion 36 extending therebetween. Clip body second leg 30 slopes in the direction of clip body proximate end 38. Clip body distal end 40 extends outwardly with respect to leg 28. Clip body 22 further includes an L-shaped clip member 90 having first leg 92 and a second leg 94. L-shaped clip member first leg 92 extends substantially perpendicularly from bridge portion 36. L-shaped clip member second leg 94 is positioned substantially parallel to bridge portion 36. L-shaped clip member second leg 94 has a distal end 96 which extend outwardly and an optional elongated tongue 97 which extends along the longitudinal axis of clip member second leg 94. Mounting 24 extends substantially perpendicularly from clip body exterior surface 34. S-shaped light holder 26 has a first semi-circular gripping member 98 and a second semi-circular gripping member 100. First semi-circular gripping member 98 is connected to mounting 24, however, second semi-circular gripping member 100 can also be connected to mounting 24.

Mounting clip 20 can be mounted on an object such as a gutter (not shown) by pulling clip body second leg 30 away from clip body first leg 28 and sliding clip body 22 around the gutter. Alternatively, L-shaped clip member second leg 94 can be spread apart from clip body 22 such that L-shaped clip member second leg 94 can be slipped around a gutter lip. Further, a cord (not shown) can be retained between L-shaped clip member second leg and bridge portion 36 when clip body 22 is mounted around an object. Once mounting clip 20 is mounted on an object, lights can be positioned within the S-shaped light holder 26. First semi-circular gripping member 100 has a larger opening 104 than second semi-circular gripping member opening 102. S-shaped light holder 26 is formed of resilient material. Either light holder first end 106 or light holder second end 108 can be flexed in order that either opening 102 or opening 104 are enlarged such that one of respective gripping member 98, 100 grasps a light (not shown). The different sizes of gripping members 98, 100 allow for the mounting clip 20 to retain various size lights. Further, a decorative figure (not shown) or a reflector (not shown) having a groove (not shown) can be displayed by fitting tongue 97 within the groove of the decorative figure or reflector. Greater detail regarding the mounting of a decorative figure or reflector on my mounting clip is discussed below with respect to FIG. 12.

Figure 6:
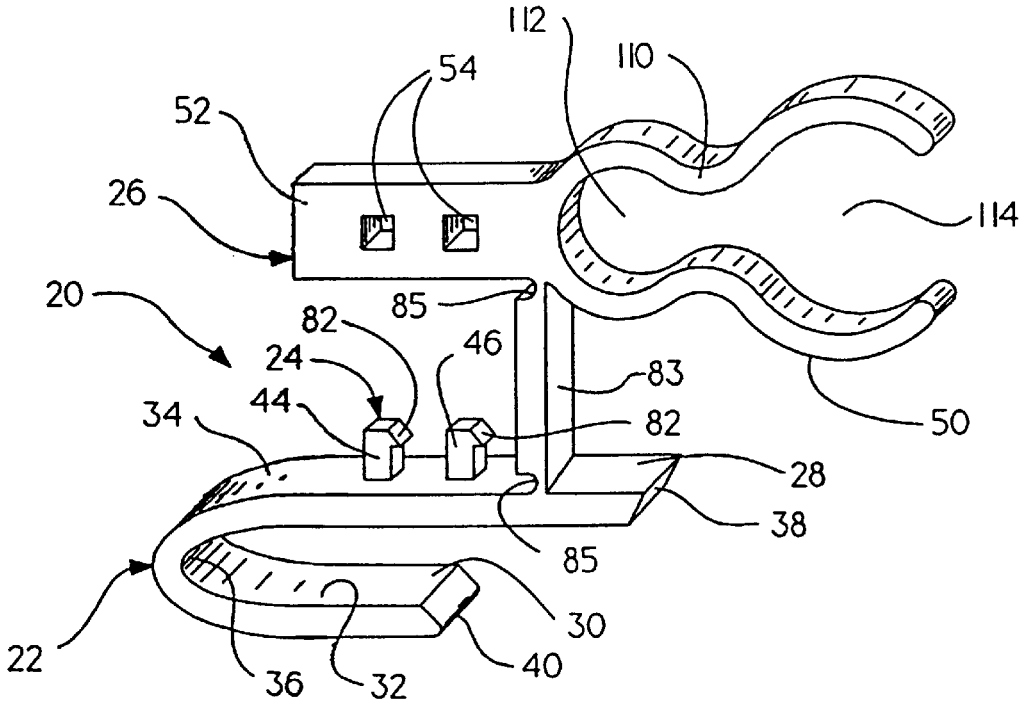
FIG. 6 is a perspective view of a sixth presently preferred embodiment of my mounting clip before it is assembled.

FIG. 6 illustrates yet another embodiment of my mounting clip 20. In order to facilitate the molding process the mounting clip 20 can be molded in a one-piece configuration and then the light holder can be separated from clip body 22 and mounting 24 which remain in a one-piece configuration. Light holder 26 is then positioned on mounting 24. Specifically, mounting clip 20 is molded to have runner 83 which extends between light holder 26 and clip body exterior surface 34. Once mounting clip 20 is completely cooled, light holder 26 can be separated from clip body 22 at hinge 85 by folding runner 83 along hinge 85. Runner 83 can then be separated from light holder at second hinge 85. Once mounting clip 20 is in two pieces, mounting 24 can engage projection apertures 54. Clamp member 50 has groove 110 which allows for clamp member 50 to retain both a small light (not shown) and a large light (not shown). A small light can be retained in a first recess 112 which is positioned adjacent projection 50. A large light can be retained in a second recess 114 which is spaced a distance away from projection 50.

Figure 7:
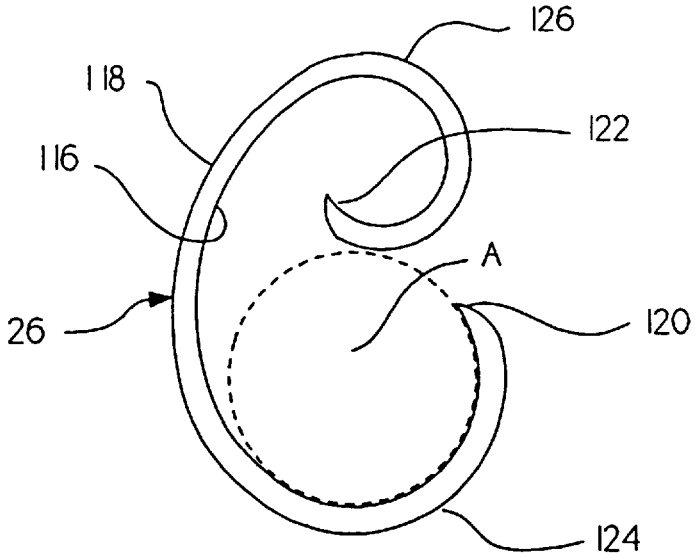
FIG. 7 is a top view of an alternative light holder which can be utilized in the fifth presently preferred embodiment of my mounting clip shown in FIG. 5.
Figure 8:
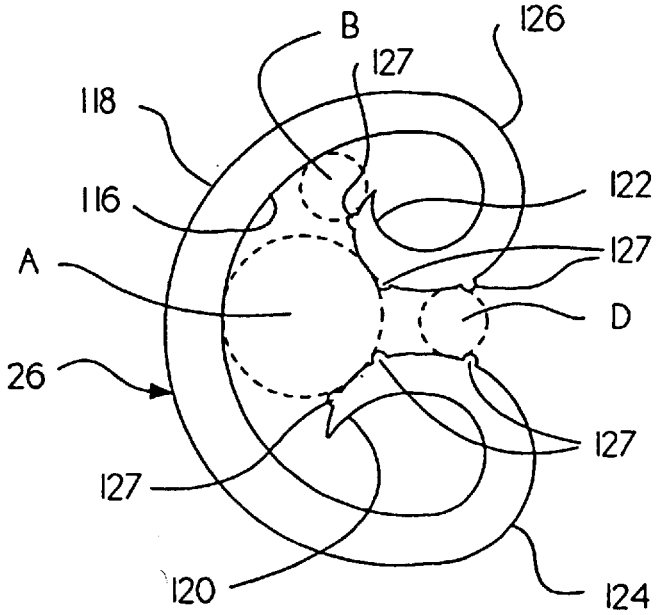
FIG. 8 is a top view of the light holder shown in FIG. 7 illustrating the retaining of multiple size lights.

FIGS. 7 and 8 illustrate an alternate C-shaped light holder 26 that can be mounted on any of the previously illustrated clip bodies 22 similarly to the light holder shown in FIG. 5. C-shaped light holder 26 is similar to S-shaped light holder 26 shown in FIG. 5. C-shaped light holder 26 has an interior surface 116, an exterior surface 118, a first end 120, a second end 122, a first curvilinear portion 124 and a second curvilinear portion 126. C-shaped light holder 26 is formed from resilient material such that it can be deformed to grip various size lights which are represented in FIGS. 7 and 8 as hidden lines. As shown in FIG. 7, first end 120 can be extended such that a large light A can be held by first curvilinear portion 124 and engaged by the exterior surface 118 at second curvilinear portion 126.

FIG. 8 illustrates other possible ways C-shaped light holder can retain various size lights. Mini light D can be gripped between exterior surface 118 at first curvilinear portion 124 and exterior surface 118 at second curvilinear portion 126. Further, a large light A can be retained by positioning light A such that exterior surface 118 at first end 120 and exterior surface 118 at second end 122 contact light A and retain light A against interior surface 116 of C-shaped light holder 26. A small light B can be retained by C-shaped light holder such that light D engages interior surface 116 at second curvilinear surface 126 and exterior surface 118 at second end 122. Nodules 127 projecting from exterior surface 118 may be molded into the C-shaped light holder 26 in order to better hold lights A, B and D in position. Although not shown, nodules 127 can be positioned along both exterior surface 118 and interior surface 116 of C-shaped light holder 26.

Figure 9:
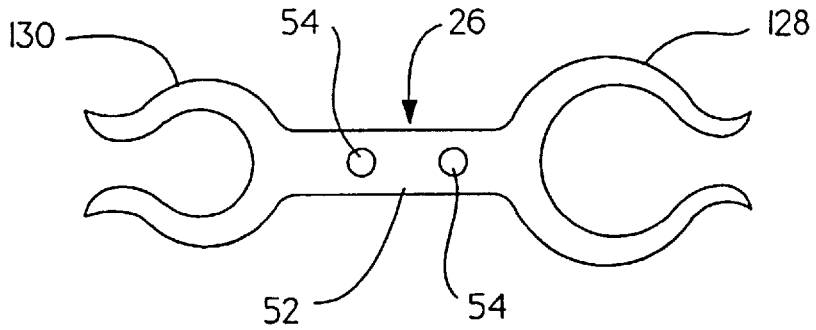
FIG. 9 is a top view of an alternative light holder which can be utilized in the first presently preferred embodiment of my mounting clip shown in FIG. 1.

FIG. 9 illustrates light holder 26 which can be utilized with clip bodies shown in FIG. 1. Light holder 26 has a first carrier member 128, a second carrier member 130 and a projection 52 extending between first carrier member 128 and second carrier member 130. First carrier member 128 and second carrier member 130 are formed of resilient material. First carrier member 128 and second carrier member 130 are different sizes such that two size lights can be displayed at the same time when light holder 26 is utilized in my mounting clip 20.

Figure 10:
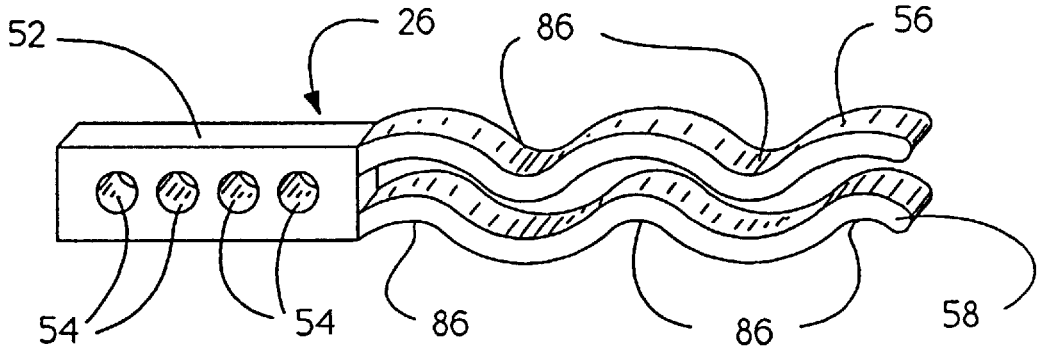
FIG. 10 is a perspective view of another light holder which can be utilized in the first presently preferred embodiment of my mounting clip shown in FIG. 1.

FIG. 10 illustrates a resilient light holder 26 which can be utilized with clip body 22 and mounting 24 shown in FIG. 1. Projection 52 includes multiple apertures 54. An adjacent pair of apertures 54 can engage mounting tabs 44, 46 shown in FIG. 1. Clamp member 50 is substantially U-shaped having a first arm 56 and a second arm 58 both of which are formed having multiple grooves 86. Grooved arms 56, 58 are made from resilient material such that arms 56, 58 can be spaced apart sufficiently to grip a light (not shown).

Figure 11:
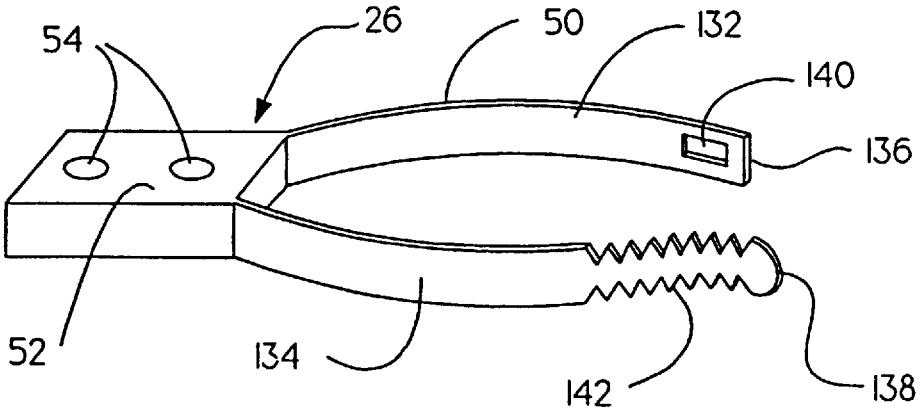
FIG. 11 is a perspective view of another light holder which can be utilized in the first presently preferred embodiment of my mounting clip shown in FIG. 1.

Light holder 26 shown in FIG. 11 can be used with mounting 24 and clip body 22 shown in FIG. 1. Light holder 26 comprises a projection 52 and a pair of interlocking arms 132, 134. Projection 52 has two apertures 54 therethrough which can engage mounting tabs 44, 46 shown in FIG. 1. Although not shown, more than two apertures 54 can be provided in projection 52 in order that the position of the light (not shown) can be adjusted. The interlocking arms 132, 134 each have a distal end 136, 138. Both of arms 132, 134 are attached to the projection 52. One of the interlocking arms 132 has a slot 140 positioned at distal end 136. The other interlocking arms 134 has barbs 142 protruding from distal end 138. Interlocking arms 132, 134 are made from a flexible material. Once interlocking arms 132, 134 are positioned around a light, interlocking arm 134 having barbs 142 is threaded through slot 140 until the light is securely retained by the mounting clip 20. Once engaged interlocking arms 132, 134 will not separate unless barbs 142 are manually withdrawn from slot 140. Although not shown both light holders shown in FIGS. 10 and 11 can be molded with a clip body 22 to form a one-piece configuration. Alternatively, interlocking arms 132, 134 can be formed from deformable material such that once the arms are positioned around a light, the distal ends 136, 138 of the interlocking arms 132, 134 can be twisted multiple times around each other in order to securely hold the light for an extended time period.

Figure 12:
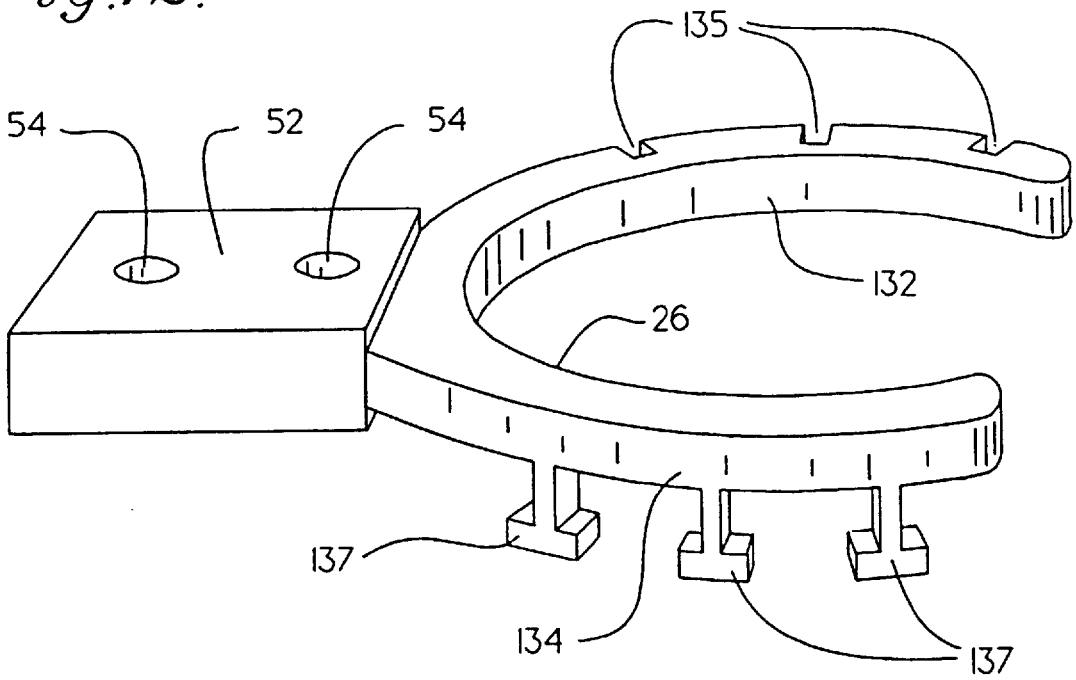
FIG. 12 is a perspective view of yet another light holder which can be utilized in the first presently preferred embodiment of my mounting clip shown in FIG. 1.

FIG. 12 illustrates light holder 26 which can be utilized with clip body 22 shown in FIG. 1. Light holder 26 includes projections 52 with two apertures 54 and a pair of interlocking arms 132, 134. One of the interlocking arms 132 has a plurality of slots 135 positioned along the one of the interlocking arm 132. The other of interlocking arm 134 has a plurality of toggles 137 positioned along the other of the interlocking arm 134. After the interlocking arms 132, 134 are positioned around a light (not shown), toggles 137 engage slots 135 in order that light holder 26 retains the light.

Figure 13:
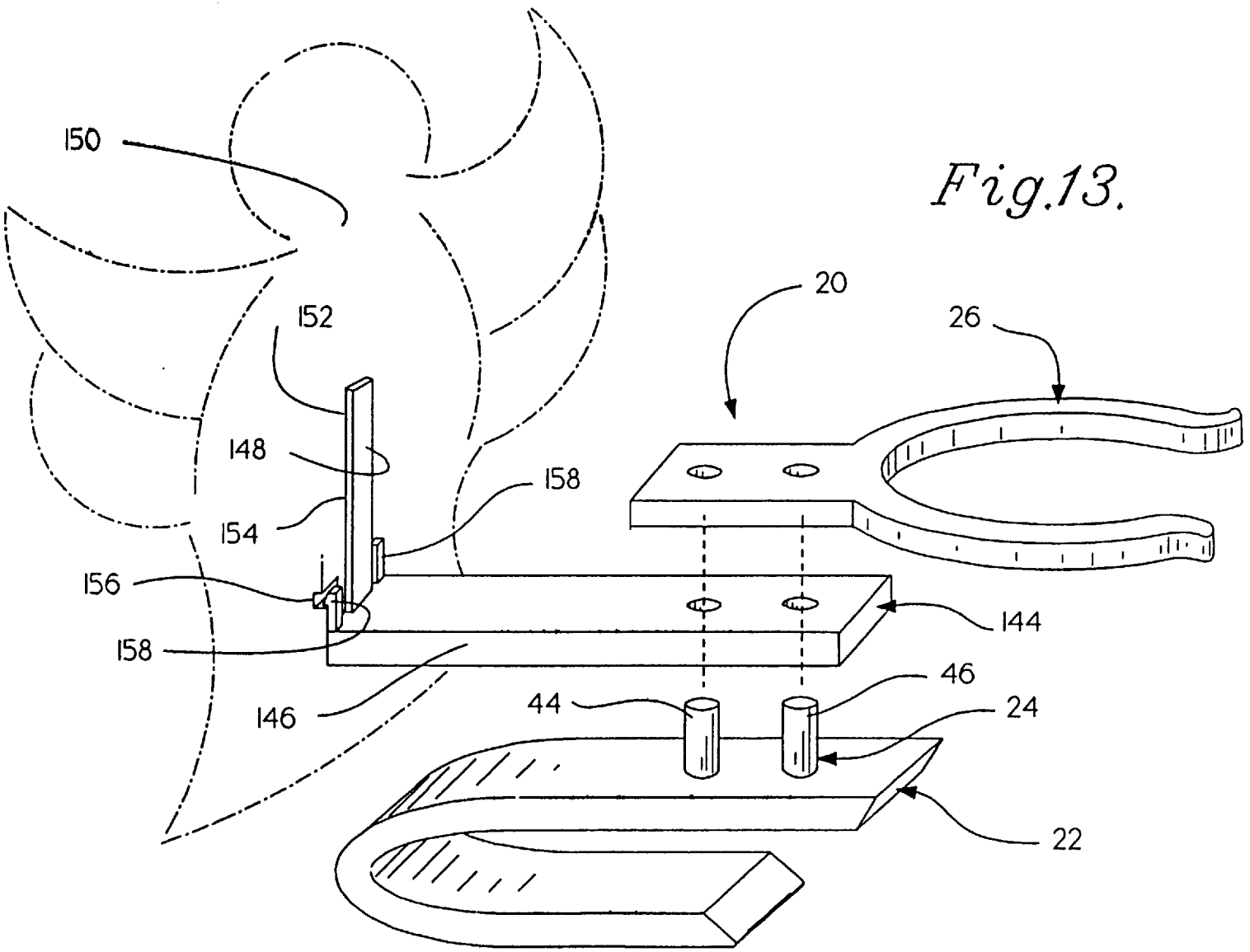
FIG. 13 is a perspective view of my mounting clip being utilized with a display holder.

In FIG. 13, I show my mounting clip 20 similar to that shown in FIG. 1 utilized in combination with a display holder 144. Clip body 22 is shown with mounting 24 being first tab 44 and second tab 46. Both reflector (not shown) or decorative display holder 144 and light holder 26 are mounted on mounting 24. Display holder 144 could be a one-piece configuration but preferably is a base 146 and an upright portion 148. Upright portion 148 extends from base 146 and supports a removable figure 150 (illustrated in hidden lines) which surrounds upright perimeter 152 and engages a guide edge 154 on upright perimeter 152. Decorative figure 150 has a slot (not shown) with a bevelled edge (not shown) which mates with guide edge 154 having a complimentary bevelled surface (not shown). Decorative figure 150 is shown as a angel but can be in any form such as a snowman or star and as well as a reflector. Decorative figure 150 is preferably made of a transparent or translucent material so that light emitted from a light (not shown) will pass through decorative figure 150 and illuminate it. Decorative figure 150 is further provided with recesses 156 which are engaged by locking tabs 158 extending substantially perpendicularly from base 146. Locking tabs 158 prevent decorative figure 150 from moving transversely. Although light holder 26 is shown behind decorative figure 150, display holder 144 could also be positioned so that decorative figure 150 would be located behind the light. This would allow passersby to see the light bulb as well as decorative figure 150 positioned therebehind. Alternatively, display holder 144 can be eliminated by molding upright portion 148 directly onto clip body 22 or by fastening upright portion 148 to clip body 22 by other means such as hooks (not shown). Further, a decorative figure similar to decorative figure 150 having a groove can be mounted on tongue 97 of second leg 94 shown in FIG. 5. The preferred display is the subject of my U.S. patent application Ser. No. 101,738, filed Aug. 4, 1993.

I prefer to make my clip holder of clear polycarbonate. However, a variety of other plastics or metals could also be used. Further, more than one type of plastic or material can be used in one mounting clip 20. For example, light holder 26 when formed separate from the clip body 22 and mount 24 can be formed of one type of plastic such as polycarbonate, and clip body 22 and mounting clip 24 can be made of a cheaper material.

Although not shown, any illustrated light holder can be adapted to be utilized with any mounting clip combination shown. Specifically, both the light holders illustrated in FIGS. 10 and 11 can be adapted to be utilized with mounting and clip body shown in FIG. 2. Further, any mounting shown can be adapted to be utilized with any clip body shown. My mounting clip is suitable for attachment to gutters and roofing shingles in addition to any object having a planar portion, over which the clip can be fitted.

Although I have illustrated and described presently preferred embodiments of my mounting clip it should be distinctly understood that my invention is not limited thereto, but may be variously embodied within the scope of the following claims.

I claim:

1. A mounting clip comprising:

(a) a generally U-shaped clip body having a first leg, a second leg, a bridge portion extending between the first leg and the second leg, an interior surface, an exterior surface, a proximate end and a distal end, the clip body made of resilient material such that the distal end and the proximate end can be sufficiently spread apart so that an object can be inserted therebetween and the clip body will grasp the object adjacent the interior surface;

(b) a mounting extending from the clip body exterior surface and having a first tab and a second tab spaced apart and extending substantially perpendicular to the exterior surface; and (c) a light holder having:

(i.) a projection containing a plurality of apertures and the first and second tabs extending through two of the apertures wherein each of the first tab and the second tab have a stop positioned a distance away from the exterior surface such that when a light is mounted within the light holder the light will not come in contact with an object; and (ii.) a first gripping member at one end and a second gripping member at an opposite end, both gripping members sized and shaped to grip a socket of a decorative light.

2. A mounting clip comprising:

(a) a generally U-shaped clip body having a first leg, a second leg, a bridge portion extending between the first leg and the second leg, an interior surface, an exterior surface, a proximate end and a distal end, the clip body made of resilient material such that the distal end and the proximate end can be sufficiently spread apart so that an object can be inserted therebetween and the clip body will grasp the object adjacent the interior surface;

(b) a mounting extending from the clip body exterior surface;

(c) a light holder connected to the mounting, and (d) a display holder having a base and an upright portion, the upright portion attached to the base, the upright portion having a guide edge adapted to receive a decorative figure which has a mating slot sized to fit over the upright such that the decorative figure is retained from transverse movement by the guide edge.

3. The mounting clip of claim 2 wherein the display holder has at least one locking tab attached to the base, the locking tab being sized and positioned to engage the decorative figure.

4. A mounting clip comprising:

(a) a generally U-shaped clip body having a first leg, a second leg, a bridge portion extending between the first leg and the second leg, an interior surface, an exterior surface, a proximate end and a distal end, the clip body made of resilient material such that the distal end and the proximate end can be sufficiently spread apart so that an object can be inserted therebetween and the clip body will grasp the object adjacent the interior surface;

(b) a mounting having a first end attached to the clip body exterior surface and a second end a selected distance from the clip body exterior surface; and (c) a light holder having first and second flexible arms in a common plane and connected together, each arm attached to the second end of the mounting at one end of that arm and spaced apart at an opposite distal end of that arm, the first flexible arm having a curvilinear portion sized and shaped to define a circular opening smaller than a diameter of a socket of a first selected decorative light and the second flexible arm having a curvilinear portion sized and shaped to define a second circular opening smaller than a diameter of a socket of a second selected decorative light, the curvilinear portions being sufficiently flexible to define an opening larger than a diameter of a socket of the selected decorative light, and to hold the selected decorative light socket.

5. The mounting clip of claim 4 wherein the clip body distal end is tapered.

6. The mounting clip of claim 5 wherein at least a portion of the clip body interior surface is one of a roughened surface and a grooved surface.

7. The mounting clip of claim 4 wherein both the proximate end and the distal end are bevelled inwardly with respect to the mounting clip.

8. The mounting clip of claim 4 wherein the clip body second leg is sloped toward the proximate end forming an opening between the proximate end and the distal end which is shorter in length than a distance between the first leg and the second leg adjacent the bridge portion, and the distal end is substantially parallel to the proximate end.

9. The mounting clip of claim 4 wherein the clip body, the mounting, and the light holder are molded to form a one-piece construction.

10. The mounting clip of claim 4 wherein the clip body has a generally L-shaped resilient clip member extending from the bridge portion in a direction opposite from the clip body first leg and the clip body second leg.

11. The mounting clip of claim 4 also comprising at least one rib attached to and extending at least partially across an interior surface of the first leg which interior surface faces the second leg.

12. The mounting clip of claim 4 also comprising at least one nodule attached to one of the flexible arms and positioned to engage the base of a selected decorative light placed between the flexible arms.

13. The mounting clip of claim 4 wherein the first leg and the second leg are shaped so that there is a first distance between the distal ends of the first leg and the second leg and a second distance between the first leg and the second leg at a point between the distal ends and the bridge, the second distance is greater than the first distance, and such shape enables the clip to fit over, conform to and grip a gutter lip in a manner to resist outward horizontal forces.

14. The mounting clip of claim 4 wherein the first and second flexible arms define an S-shape.

* * * * *